United States Patent [19]

Persson

[11] 3,943,820

[45] Mar. 16, 1976

[54] METHOD FOR CHARGING DRILL HOLES WITH EXPLOSIVE

[75] Inventor: Per-Anders Persson, Stockholm, Sweden

[73] Assignee: Nitro Nobel AB, Gyttorp, Sweden

[22] Filed: Dec. 21, 1972

[21] Appl. No.: 317,195

[30] Foreign Application Priority Data

Dec. 30, 1971 Sweden ..... 16917/71

[52] U.S. Cl. ..... 86/20 C; 149/19.1; 149/44; 264/3 R

[51] Int. Cl.[2] ..... C06B 19/00; C06B 19/04

[58] Field of Search ..... 86/1 R, 20 R, 20 C

[56] References Cited

UNITED STATES PATENTS

| | | | |
|---|---|---|---|
| 2,670,101 | 2/1954 | Heisterkamp et al. | 86/20 R UX |
| 3,005,373 | 10/1961 | Ransom, Jr. | 86/20 C |
| 3,303,738 | 2/1967 | Clay et al. | 86/1 R X |
| 3,424,438 | 1/1969 | Knotts et al. | 86/20 C UX |
| 3,791,255 | 2/1974 | Fox et al. | 86/20 C |

*Primary Examiner*—Leland A. Sebastian

*Attorney, Agent, or Firm*—Shlesinger, Fitzsimmons & Shlesinger

[57] ABSTRACT

This invention relates to a method of charging drill holes for blasting, according to which method solid and liquid components of an explosive substantially each of them separately but simultaneously are blown or pumped, respectively, through its individual hose channel into the drill hole within which the components are intermixed as a result of the simultaneous pumping and blowing operations. The invention relates also to various recipes for preparation of explosives possessing properties especially fitted for the method in consideration. The invention also comprises an apparatus suited for carrying out the method.

17 Claims, 3 Drawing Figures

Figures 1, 2, 3:
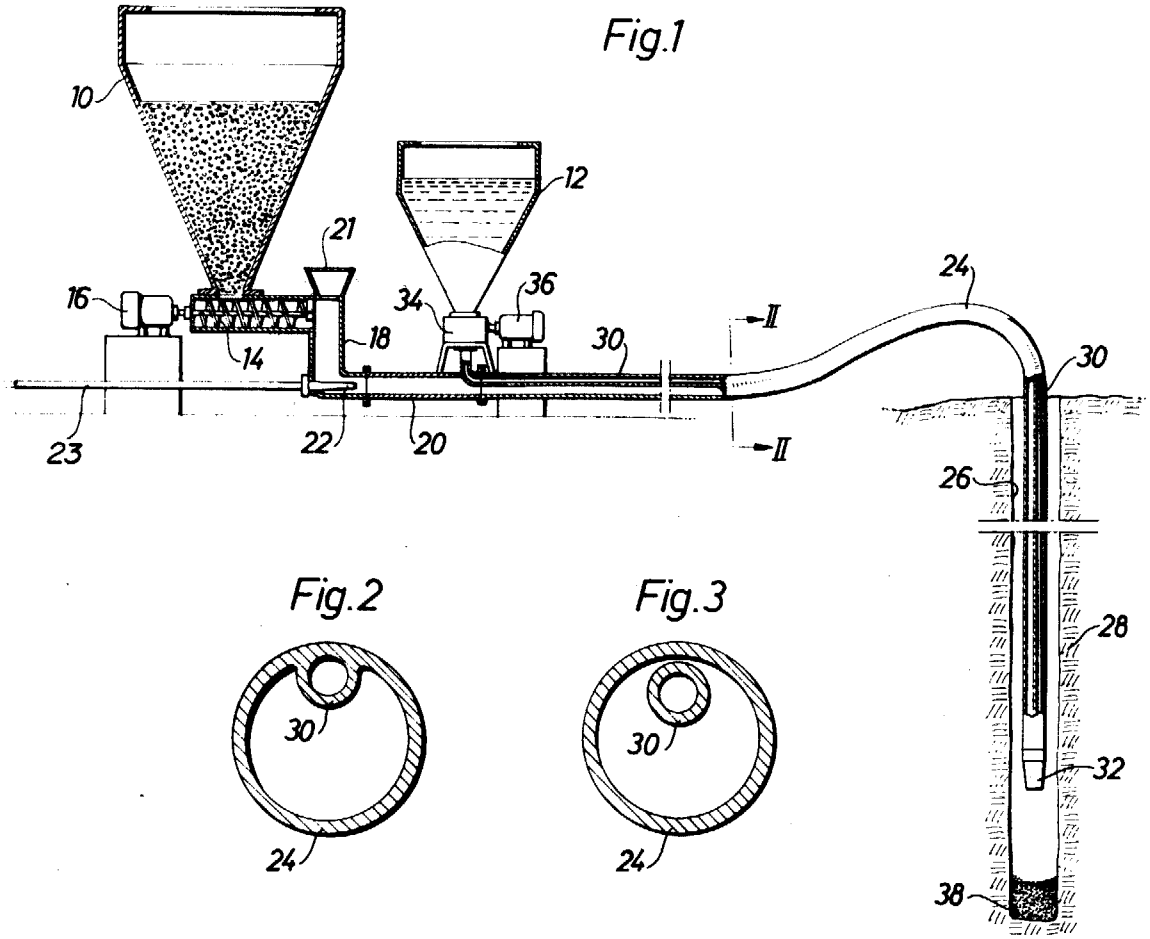

10
12
14
16
18
20
21
22
23
24
26
28
30
32
34
36
38
II
II 30
24

30
24

METHOD FOR CHARGING DRILL HOLES WITH EXPLOSIVE

BACKGROUND OF THE INVENTION

The endeavor of rendering easier and mechanizing the work of charging in connection with rock blasting has resulted in the development of different systems for introduction of explosive into drill holes or other cavities formed in rock, which cavities in the following specification and in the appended claims shall be understood to be included in the term "drill hole." Such systems exist in different embodiments, but can be grouped in the following three principal types:

THE PRIOR ART

1. The first type is the pneumatically operated charging apparatus for cartridges of the kind described in the U.S. Pat. No. 2,824,483, in the operation of which factory-made plastic explosives in cartridges made of paper or plastic material are conveyed or blown by means of compressed air through a tube or hose to a mouthpiece in the end of the hose inserted down into the drill holes where the wrapping of the cartridge is cut up by means of knives installed in the mouthpiece so that the explosive can be packed so as to completely fill out the hole with a density of charge amounting to up to 1.5 kgs per liter by imparting to the charging tube or pipe a reciprocating movement.

The pneumatic cartridge charging technique often affords optimum utilization of an existent hole volume, but has the drawback that the price of the explosive is increased by the costs for cartridging, packaging and shipping by involving the necessity of observing rigorous safety regulations due to the relatively high sensitivity of the explosive.

2. The second type is the pneumatically operated apparatus for powder charging, in the operation of which pulverulent or granulated explosive in bulk by means of compressed air is blown into the drill hole through a flexible tube or hose. The explosive, preferably consisting of crystalline or granulated (prilled) ammonium nitrate mixed with fuel oil — which type of explosive has low initiation sensitivity and hereinafter will be denoted ANFO — sticks to vertical or upwardly inclined holes, or to horizontal holes, when the granules of explosive with a relatively high speed strike on and completely or partly are crushed against, one another or the wall of the drill hole. This type of charging technique results in an inferior utilization of the volume at disposal of the drill holes because the density of charging becomes low, namely between 0.8 and 1.1 kgs per liter. The explosive is also weaker per kilogram and has only 65 per cent of the blasting effect of blasting gelatine. In a specific embodiment which can be applied to large, downwardly directed drill holes only, the charging with ANFO explosive is effected without propelling by compressed air, the explosive instead being advanced to the upper end of the drill hole by a feeder screw and caused to fall down under the action of gravity into the hole. The action of the ANFO explosives however, can be imperilled by water penetrating into the drill hole. Therefore, its use is limited to dry drill holes.

3. The third main type is that category where the explosive by addition of water has been made more or less a thin liquid slurry and also has become so insensitive to initiation that it can be pumped with a mechanical pump through a tube or hose to the opening in a downwardly directed drill hole. In this case also, the explosive is handled in bulk.

Explosives of this type which hereinafter will be called slurry explosives, result when compared with ANFO explosives, in a higher density of charge in the drill hole, viz from 1.2 to 1.6 kgs per liter, and can be manufactured in compositions having considerably greater blasting effect than ANFO explosives, as calculated both per kilogram and in particular per unit of volume of the drill hole. They have the disadvantage, however, that they cannot be used in upwardly directed or horizontal holes due to their liquid consistency which is a prerequisite for the pumping. The charging tube, wholly filled with the viscous explosive, becomes also heavy and difficult to handle especially in connection with the charging of drill holes having large diameter.

It is known that it is advantageous in connection with rock blasting to have a heavier bottom charge in the lower part of the hole and a weaker column charge in the remainder of the charged part of the drill hole. Therefore, two different types of explosive are often used in each individual drill hole. In a particular embodiment of the slurry charging system this is obtained by intermixing various ingredients of the slurry in immediate adjunction to the charging pump. In this way the proportions between the ingredients and therewith the bursting strength can be controlled in different portions of the hole.

In a particular embodiment of the slurry charging system thickening or gelling agents are added near the pump that pumps the explosive down into the drill hole. Thickening or gelling of the liquid phase prevents the explosive from slowly leaking out into fissures in the rock or some of its constituents from being dissolved in water-bearing rock formations. Some time after the explosive has come to rest in the drill hole, the explosive acquires a less fluid consistency. This time, which is determined by the velocity with which the solidification proceeds, is too long in hitherto known systems to permit use of the system in upwardly directed or even horizontal drill holes.

OBJECTS AND ADVANTAGES OF THE INVENTION

One main object of this invention is to provide a method for charging drill holes with an explosive mixture composed of solid and liquid constituents, and according to one main feature of the inventive method solid and liquid components for the explosive are introduced into drill hole each through its individual hose, the mainly solid components being advanced within the one hose in a manner known per se by a stream of compressed air, and the mainly liquid components, in a manner also known per se, streaming and preferably being pumped through the other hose to a spraying nozzle disposed at the end of the hose opening into the drill hole. Another characterizing feature of the invention is the use of specific compositions of explosive in which the content of the component in liquid state is lower and/or the content of gelatinizers and/or thickeners is higher than in previously utilized pumpable explosives of, for instance, the slurry type, and in which the liquid content is higher than in a pulverulent explosive of the ANFO type. According to the invention the volume of the hole, at least in the deeper part thereof, can be packed completely with an explosive with high charging density, such as e.g. from 1.1 to 2.0 kgs per liter hole volume, while at the same time the explosive is imparted such a consistency that it sticks also to the walls of upwardly directed or horizontal holes, and if required can be protected against deterioration by extraction by partial or total dissolution in water penetrating into, or present in, the drill hole.

A further essential advantage of the invention is that the larger channel, through which the mainly solid components are fed in by a stream of compressed air, may be emptied of explosives between each charging step, e.g. every time when the charging of one drill hole has been finished. When compared with the slurry charging system having a comparable capacity, the charging tube therefore becomes lighter and easier to handle.

EXAMPLES

General Viewpoints

In connection with the machanization of the blasting and drilling work, considerable progress and great advantages from the viewpoint of safety can be obtained to the same extent as the explosive is imparted with reduced sensitivity to mechanical impact. The invention renders possible a substantial progress in this direction by the feature that the final consistency and composition specifically intended for initiation and detonation is attained only at the bottom or inner end of the drill hole. According to a particular composition as will become evident from Example 1 to be given below, neither the liquid nor the solid component in itself is an explosive. In this way by handling the components separately rather than pre-mixing them to form an explosive substance, all those complications are eliminated with regard to manufacture, storage, shipping and handling at the site of the blasting operation, which reside in the fact that a substance is an explosive. In the strict way of interpretation every chemical compound and each mixture of chemical compounds can be defined as an explosive if it has the capacity of becoming decomposed or otherwise reacting chemically while releasing thermal energy (exothermic reaction). As is conventional practice, there are included in the following description in the group "non-explosives or not explosives," such substances as e.g. ammonium nitrate and mononitrotoluene or much diluted highly explosive substances, which of course according to the strict definition can be designated as explosives, but which from the viewpoints of risk and handling in connection with the charging of drill holes due to their extraordinarily low sensitivity to initiation can be regarded as practically inert substances.

According to another composition (as Examples 2*a*, 2*b*, 2*c* and 3) one component is of course an explosive, but is safe when being handled; whereas the other component is not an explosive. In a third composition (Example 4) each of two components is an explosive in itself.

As will be indicated in Examples 1 through 4, the liquid component may either be an aqueous solution or emulsion or some substantially anhydrous liquid, emulsion or solution in such a liquid.

In this connection it is, on the one hand, especially advantageous to use as ingredients substances soluble in, or mixable or emulsifiable with water, which substances may be, but not necessarily must be, explosive in pure state, together with water-soluble oxygen delivering substances such as e.g. ammonium nitrate, sodium nitrate, calcium nitrate, and if desired with adjuvants such as chlorates or perchlorates. Examples of such ingredients are hydrazine and hydrazine nitrate or perchlorate, and furthermore nitrated glycols of varying linear or chain length, e.g. tetramethyleneglycol dinitrate or hexamethyleneglycol dinitrate. Additional examples are saturated aliphatic amines neutralised by nitric acid, among which monomethylene nitrate already has been mentioned as a particularly suitable compound.

On the other hand, there are especially suitable in addition to the substances mentioned in the examples of the same type, substantially anhydrous, but liquid components, such as e g partially nitrated aromatic or cyclic compounds, preferably in isomeric mixtures. Even in this case, the ingredients may in themselves be explosive substances. However, this property is not an indispensable condition.

At all events, the result obtained by means of the ingredients stated hereinbefore is that the liquid component itself either cannot be initiated to detonate or is so insensitive to initiation that it can be handled safely by equipment containing elements sliding relatively to one another, e g a rotary or reciprocative pump or a stop-cock.

In those cases where at least the one component is an explosive or where in some other way a varying mixing rate is functionally possible, the flow of one of the components can be varied and/or interrupted totally during the filling of the drill hole. In this way the charge in the inner portion of the hole can be made stronger than in the outer portion of the hole.

The protection against water in the drill hole can according to the invention be improved further over that inherent in a well packed charge due to its almost rigid consistency which only slowly is attacked by water, by having the composition contain thickening or gelling agents of conventional nature and known per se. According to a specific embodiment of the invention this is effected by admixing beforehand to the solid component a gelling agent for the liquid phase, e.g., guar gum, when this liquid phase is aqueous, amounting to a content of between 0.1 and 5.0 per cents by weight calculated on the final explosive composition, said agent upon the intermixture of the components within the drill hole thickening or gelling the liquid phase. An additionally improved protection against water, combined with an increase of the mechanical coherence, is obtained in a particularly advantageous embodiment by adding, in addition to the thickening or gelling agent admixed to the solid phase, an oxidizing agent to the liquid phase, said oxidizing agent cross-linking the gel. In those cases where the liquid phase is an aqueous one, an oxidizing agent of the type of alkali metal dichromate is preferred either alone or in combination with a soluble antimony compound. Also borax or polyacrylic amide may be employed together with gelling agents of the guar gum type. In general it is easily understood by an expert in the art that there are many other methods for thickening, gelling or in other ways protecting the final explosive composition against water, which are all made applicable by the present invention which keeps the adjuvants separated from one another and/or from some of the explosive components until the very moment they are all mixed together at the desired place of blasting in the drill hole.

SPECIFIC EXAMPLES 1 TO 4

From the Table presented hereinafter the compositions of both the liquid phase and the solid phase of the explosive mixture together with data regarding the density in drill holes, the calculated explosive energy $Q$ and the gas volume $V_g$ as, well as, based on these data the weight strength for the final explosive mixture, are evident. The weight strength, which is a measure unit generally accepted in the field of rock blasting for defining the efficiency of a blasting explosive in disintegration of rock, has in conventional manner been computed from the formula $$S = \frac{5}{6}\,\frac{Q}{Q_o} + \frac{1}{6}\,\frac{V_g}{V_o}$$

wherein $Q_o = 5000$ Joules per gram and $V_o = 848$ cm$^3$ per gram.

The term oxygen balance is intended to indicate that surplus or deficit of oxygen gas which is left or required respectively, in a complete combustion of the components forming part of an explosive mixture or substance. The oxygen balance is stated in per cent by weight on the Table separately for, respectively, the solid phase, the liquid phase and the final explosive mixture.

| Example No | 1 | 2a | 2b | 2c | 3 | 4 |
|---|---|---|---|---|---|---|
| Solid phase: (g $O_2$/g solid phase/%/) | | | | | | |
| Oxygen balance | 33.1 | −6.1 | 0.0 | −3.4 | 26.7 | 19.1 |
| Ammonium nitrate | 51.6 | 94.4 | 90.3 | 94.1 | 75.1 | 50.0 |
| Sodium nitrate | 48.4 | | | | 24.9 | 39.0 |
| Fuel oil | | 5.6 | 3.5 | 5.3 | | |
| Guar gum | | | 1.2 | 0.6 | | |
| Aluminium | | | 5.0 | | | 10.0 |
| Nitrocellulose | | | | | | 1.0 |
| Liquid phase: (g $O_2$/g liquid phase/%/) | | | | | | |
| Oxygen balance | −99 | 0.34 | 0.34 | 0.23 | −53.2 | −44.0 |
| Isopropyl nitrate | 100 | | | | | |
| Nitromethane | | | | | 60.0 | |
| Glycerol trinitrate | | | | | | 30.0 |
| Ethyleneglycol dinitrate | | | | | | 30.0 |
| Trinitrotoluene | | | | | 40.0 | |
| 2.4-dinitrotoluene | | | | | | 31.4 |
| 2.6-dinitrotoluene | | | | | | 8.6 |
| Monomethylamine nitrate | | 33.8 | 33.8 | 41.7 | | |
| Ammonium nitrate | | 34.2 | 34.2 | 23.4 | | |
| Sodium nitrate | | 10.6 | 10.6 | 7.2 | | |
| Calcium nitrate | | | | 13.0 | | |
| Water | | 21.4 | 21.4 | 14.6 | | |
| Final explosive: | | | | | | |
| Proportion by weight liquid phase to solid phase | 25/75 | 30/70 | 29/71 | 29/71 | 33/67 | 30/70 |
| Density in drill hole (g/cm$^3$) | 1.35 | 1.39 | 1.40 | 1.47 | 1.45 | 1.40 |
| Explosive energy (kcal/g) | 0.99 | 0.85 | 0.97 | 0.87 | 1.11 | 1.40 |
| Gas volume l/g | 0.698 | 0.973 | 0.913 | 0.956 | 0.785 | 0.591 |
| Weight strength | 0.83 | 0.78 | 0.86 | 0.80 | 0.93 | 1.04 |
| Oxygen balance (g $O_2$/g explosive/%/) | 0.8 | −4.2 | 0.1 | −0.2 | 0.3 | 0.0 |

In the accompanying drawing an apparatus for carrying out the method of the invention is shown by way of example, in which drawing FIG. 1 is a partially sectional side elevational view of the apparatus and a drill hole formed in a rock formation;

FIGS. 2 and 3 are enlarged sectional views taken along the line II—II of FIG. 1 and illustrating two alternative structures of a hose or flexible tube used with this apparatus and comprising two separate channels.

Referring now to the drawing, reference numeral 10 denotes a suitably hopper-shaped vessel for the solid, pulverulent or granular component of the explosive composition. Another vessel 12 is intended to receive the liquid component of said composition. Provided at the apertured bottom of the vessel 10 is a screw conveyer 14 which is driven by a motor 16 and which feeds the solid component into a vertical duct 18 the lower portion of which merges into a horizontal duct 20. Opening into the latter duct is an ejector 22 which through a pipe 23 is in communication with a source (not shown) for compressed air. Secondary ejector air may be taken in through a suction lattice 21 provided at the top of the vertical duct 18. The pulverulent component pouring down in the duct 18 is blown by the air enterng through the ejector 22 through the duct 20 and a hose or flexible tube 24 connected to said duct 20 and having such a length that it extends into and down within the drill holes to the vicinity of the inner end or bottom thereof. One such drill hole 26 is shown in FIG. 1 in a rock formation 28. The hose or pipe 24 is wholly or partly made of pliable or flexible material, and opens at its free end which is inserted into the drill hole to extend downwards therein. Another hose or tube 30, is coupled together with the hose or tube 24 and preferably imbedded in the same. The hose or tube 30 which thus has a minor cross-sectional area than the hose or tube 24, can either be molded in one piece together with the hose 24 as is shown in FIG. 2, or may constitute a separate element within the hose 24 as is shown in FIG. 3. The hose with the smaller diameter, in the present case the hose 30, extends along the hose with the larger diameter, in the illustrated embodiment the hose 24, to or adjacent the free end of the latter. One or both of the hoses, in the embodiments shown in the FIGS. 2 and 3, the outer one, may at its free or discharge end be equipped with a mouthpiece 32 for the control of the mixing process. The liquid component of the explosive mixture is supplied to the hose 30 with the minor diameter by means of a pump 34 located below the vessel 12 and driven by a motor 36. The pump 34 may be of the displacement type so as to obtain a dosing or controlled discharge of the liquid component by variation of the number of revolutions of the motor 36. Also the conveyer screw 14 may have variable speed for dosing of the supplied quantity of the solid component. A control of the quantity of supplied liquid phase can also be accomplished by means of an adjustable throttle valve, if desired in combination with an adjustable pump unit.

OPERATION OF THE PREFERRED APPARATUS

In the operation of the apparatus a simultaneous feeding of the two components is effected to the discharge end, which is held down into the drill hole, of the double-hose 24, 30. In this feeding operation the solid component is carried by an air stream, the liquid component being injected into the hole 26 and therein intimately intermixed with, and interconnecting the particles of, the solid component so as successively and completely to fill the drill hole with a charge 38 of explosive composition ready for initiation. The carrier air escapes in an upward direction through the drill hole 26. The composition of and the proportion between, the components of the explosives mixture are evident from the description hereinbefore. During the filling of the hole 26 at which time the hose 24, 30 successively is drawn out of the hole as it fills with the charge 38, the density of the charge and therewith its explosive strength can be reduced e.g. by reduction or, if desired, complete interruption of the supply of the liquid component.

While at least two specific embodiments of an apparatus for carrying out one preferred variant of the method according to the invention has been shown and described, it is to be understood that this is for the purpose of illustration only, and that the invention is not to be limited thereby, but its scope is to be determined by the appended claims.

What is claimed is:

1. A method of charging a drill hole with an explosive mixture having a solid component and a liquid component, comprising using a stream of compressed air to conduct the solid component into the drill hole and simultaneously delivering the liquid component into the drill hole at the same point as the solid component while maintaining the two components entirely separated from one another until they are delivered into the interior of the drill hole so that they are mixed with one another only when both are in the drill hole.

2. A method of charging a drill hole according to claim 1, wherein the two components of the explosive mixture are conducted into the drill hole through separate hoses whose discharge ends terminate at said same point and are disposed in the drill hole, and the liquid component is pumped through its hose while the solid component is being forced by the stream of compressed air through its hose.

3. The method as claimed in claim 1, wherein the rates at which the two streams of components are fed into the drill hole are adjusted relative to each other so that the explosive mixture formed by them and filling out the cross-section of the drill hole obtains a density

4. The method as claimed in claim 3, wherein the obtained density exceeds 1.2 grams per cubic centimeter.

5. The method of charging a drill hole as claimed in claim 3, wherein the supply of the liquid component is adjustable during the charging process.

6. The method as claimed in claim 1, wherein neither the solid nor the liquid component, until introduced into and intermixed one with the other in the drill hole, is an explosive.

7. The method as claimed in claim 1, wherein the solid component, but not the liquid component that is introduced into the drill hole, is an explosive substance.

8. The method as claimed in claim 1, wherein the proportion by weight of the liquid component introduced into the drill hole at the temperature of the rock surrounding the drill hole is higher than 6 per cent but lower than 40 per cent of the explosive mixture, and is so low as to cause the charge to have a consistency sufficient to cause it to stick to the walls of upwardly directed and horizontally extending drill holes.

9. The method as claimed in claim 1, wherein the solid component introduced into the drill hole comprises a substantially oxygen-balanced mixture of ammonium nitrate and fuel oil.

10. The method as claimed in claim 9, wherein the solid component contains an admixture of an adjuvant comprising also a substantially oxygen-balanced mixture of ammonium nitrate with at least one substance selected from the group consisting of aluminum, trinitrotoluene, and monomethylamine nitrate.

11. The method as claimed in claim 7, wherein the solid component introduced into the drill hole contains between 0.1 and 5.0 per cent by weight, calculated on the weight of the whole explosive composition, of an agent adapted to gel said liquid component.

12. The method as claimed in claim 11, wherein the gelling agent is a substance, selected from the group consisting of guar gum, polyacryl amide and nitrocellulose.

13. The method as claimed in claim 12, wherein the solid component contains a gelling agent selected from the group consisting of guar gum and polyacryl amide, and the liquid component contains at least one oxydizing agent for cross-linking the gelling agent, said oxydizing agent being an alkali metal di-chromate.

14. The method as claimed in claim 7, wherein the solid component introduced into the drill hole contains between 0.1 and 5.0 per cent by weight, calculated on the whole weight, of the explosive composition of an agent adapted to thicken the liquid phase.

15. The method as claimed in claim 6, wherein the liquid component mainly comprises an oxygen-balanced aqueous solution of at least one of the substances selected from the group consisting of monomethylamine nitrate, ammonium nitrate and sodium nitrate.

16. The method as claimed in claim 15, wherein the liquid component in addition contains at least one other substance selected from the group consisting of a nitrate, chlorate, and a perchlorate.

17. The method as claimed in claim 6, wherein the liquid component comprises at least one of the substances selected from the group consisting of trinitrotoluene, di-nitrotoluene, mono-nitrotoluene, nitromethane, isopropyl nitrate, glycerol-tri-nitrate and ethylene glycol di-nitrate.

* * * * *